US012345005B2

(12) United States Patent
Vahling et al.

(10) Patent No.: US 12,345,005 B2
(45) Date of Patent: Jul. 1, 2025

(54) DUAL STAGE LIFT SYSTEM FOR A SNOW WING

(71) Applicant: Caterpillar Inc., Peoria, IL (US)

(72) Inventors: Bruce Raymond Vahling, Urbana, IL (US); Benjamin J. Kovalick, Chillicothe, IL (US); Nathaniel Keith Harshman, Sullivan, IL (US)

(73) Assignee: Caterpillar Inc., Peoria, IL (US)

( * ) Notice: Subject to any disclaimer, the term of this patent is extended or adjusted under 35 U.S.C. 154(b) by 706 days.

(21) Appl. No.: 17/651,332

(22) Filed: Feb. 16, 2022

(65) Prior Publication Data

US 2023/0257950 A1 Aug. 17, 2023

(51) Int. Cl.

| | |
|---|---|
| ***E01H 5/06*** | (2006.01) |
| ***E02F 3/76*** | (2006.01) |
| ***E02F 3/96*** | (2006.01) |

(52) U.S. Cl.

CPC ..... *E01H 5/067* (2013.01); *E02F 3/961* (2013.01)

(58) Field of Classification Search

CPC ..... E01H 5/061; E01H 5/063; E01H 5/067; E01H 5/062; E02F 3/961; E02F 3/765; E02F 3/844; E02F 3/8157; E02F 3/764

See application file for complete search history.

(56) References Cited

U.S. PATENT DOCUMENTS

| | | | | |
|---|---|---|---|---|
| 3,659,363 | A | 5/1972 | Snyder | |
| 3,851,710 | A | 12/1974 | Grimm | |
| 4,045,892 | A | 9/1977 | Farrell | |
| 4,096,652 | A * | 6/1978 | Raines | E01H 5/063 37/231 |
| 5,860,230 | A | 1/1999 | Daniels | |
| 6,249,992 | B1 | 6/2001 | Irving et al. | |
| 6,296,081 | B1 | 10/2001 | Nagai et al. | |
| 6,442,877 | B1 | 9/2002 | Quenzi et al. | |
| 6,581,307 | B1 | 6/2003 | Jones et al. | |
| 6,941,686 | B2 | 9/2005 | Cusick | |
| 7,134,227 | B2 | 11/2006 | Quenzi et al. | |
| 7,263,789 | B2 | 9/2007 | Hollinrake et al. | |
| 8,776,406 | B2 | 7/2014 | Stephan | |
| 8,777,545 | B2 | 7/2014 | Roux | |
| 9,303,377 | B2 | 4/2016 | May et al. | |
| 9,353,495 | B2 | 5/2016 | Becicka et al. | |
| 9,752,293 | B2 | 9/2017 | Dubiel et al. | |
| 10,053,826 | B1 | 8/2018 | Null et al. | |

(Continued)

FOREIGN PATENT DOCUMENTS

| | | |
|---|---|---|
| CA | 2703392 C | 7/2012 |
| GB | 1488015 A | 10/1977 |

*Primary Examiner* — Adam J Behrens
*Assistant Examiner* — Robert E Pezzuto

(57) ABSTRACT

In some implementations, a lift assembly for a moldboard of a snow wing assembly of a motor grader may include a first lifting mechanism mechanically coupled to an undercarriage assembly of the motor grader. The first lifting mechanism may be configured to lift the moldboard of the snow wing assembly a first portion of a bench height associated with the moldboard. The lift assembly may include a second lifting mechanism mechanically coupled to the first lifting mechanism and the moldboard. The second lifting mechanism may be configured to lift the moldboard of the snow wing assembly a second portion of the bench height associated with the moldboard.

20 Claims, 9 Drawing Sheets

(56) References Cited

U.S. PATENT DOCUMENTS

| | | | |
|---|---|---|---|
| 10,113,283 | B1 | 10/2018 | Jones |
| 10,316,480 | B2 | 6/2019 | Kemmerling et al. |
| 10,370,811 | B2 * | 8/2019 | May ..... E01H 5/067 |
| 10,480,141 | B1 | 11/2019 | Null et al. |
| 2016/0273176 | A1 | 9/2016 | Becicka et al. |
| 2020/0354910 | A1 | 11/2020 | Niemela et al. |

* cited by examiner

DUAL STAGE LIFT SYSTEM FOR A SNOW WING

TECHNICAL FIELD

The present disclosure relates generally to lift systems for a snow wing of a machine and, for example, to a dual stage lift system for the snow wing.

BACKGROUND

Machines, such as grader machines (e.g., motor graders), may use a snow wing (e.g., often including a moldboard or other snow blade) to displace, move, distribute, and/or grade snow and/or other material. The snow wing may need to be moved to various positions relative to a work surface and/or the grader machine to effectively carry out one or more of the functions described above and/or to enable other operations of the grader machine. For example, the snow wing may be mounted on a side of a cab of the grader machine and may need to be raised, relative to the ground, to performing a benching operation.

The grader machine may utilize a mast to enable the snow wing to be raised to a bench height. For example, the snow wing may be raised or lowered along the mast via one or more actuators. However, the mast may present an impediment to accessing an operator cab of the grader machine. Additionally, the mast may block or impede a view of an operator from inside of the operator cab. As another example, the grader machine may utilize a mast-less system to enable the snow wing to be raised to a bench height. However, the mast-less system may be limited as to an achievable bench height for the snow wing. Therefore, the mast-less system may be unable to perform certain operations that require a bench height greater than the achievable bench height associated with the mast-less system.

The lift assembly of the present disclosure solves one or more of the problems set forth above and/or other problems in the art.

SUMMARY

Some implementations described herein relate to a lift assembly for a moldboard of a snow wing assembly of a motor grader. The lift assembly may include a first lifting mechanism mechanically coupled to an undercarriage assembly of the motor grader, wherein the first lifting mechanism is configured to lift the moldboard of the snow wing assembly a first portion of a bench height associated with the moldboard. The lift assembly may include a second lifting mechanism mechanically coupled to the first lifting mechanism and the moldboard, wherein the second lifting mechanism is configured to lift the moldboard of the snow wing assembly a second portion of the bench height associated with the moldboard.

Some implementations described herein relate to a snow wing assembly. The snow wing assembly may include a moldboard and a lifting assembly configured to lift the moldboard to a bench height. The lifting assembly may include a four-bar linkage coupled to an undercarriage assembly of a vehicle, wherein the four-bar linkage is configured to lift the moldboard a first portion of the bench height via a first hydraulic cylinder associated with the four-bar linkage. The lifting assembly may include a lifting mechanism coupled to a member of the four-bar linkage and the moldboard, wherein the lifting mechanism is configured to lift the moldboard a second portion of the bench height.

Some implementations described herein relate to a motor grader. The motor grader may include a snow wing assembly including a moldboard and a lifting assembly for lifting the moldboard to a bench height, wherein the lifting assembly is coupled to an undercarriage assembly of the motor grader. The lifting assembly may include a first lifting mechanism mechanically coupled to the undercarriage assembly, wherein the first lifting mechanism is configured to lift the moldboard of the snow wing assembly a first portion of the bench height. The lifting assembly may include a second lifting mechanism mechanically coupled to the first lifting mechanism and the moldboard, wherein the second lifting mechanism is configured to lift the moldboard of the snow wing assembly a second portion of the bench height.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

This disclosure relates to a lift system for a snow wing, which is applicable to any machine that includes a mounted snow wing. For example, the machine may be a grader machine (e.g., a motor grader), a plow truck, a dump truck, a dozer, a backhoe loader, a tractor, an excavator, or another vehicle. In other words, although examples are described herein in connection with a motor grader, the hinge and/or coupling system described herein may be similarly applied to any machine that includes a mounted snow wing.

Figure 1:
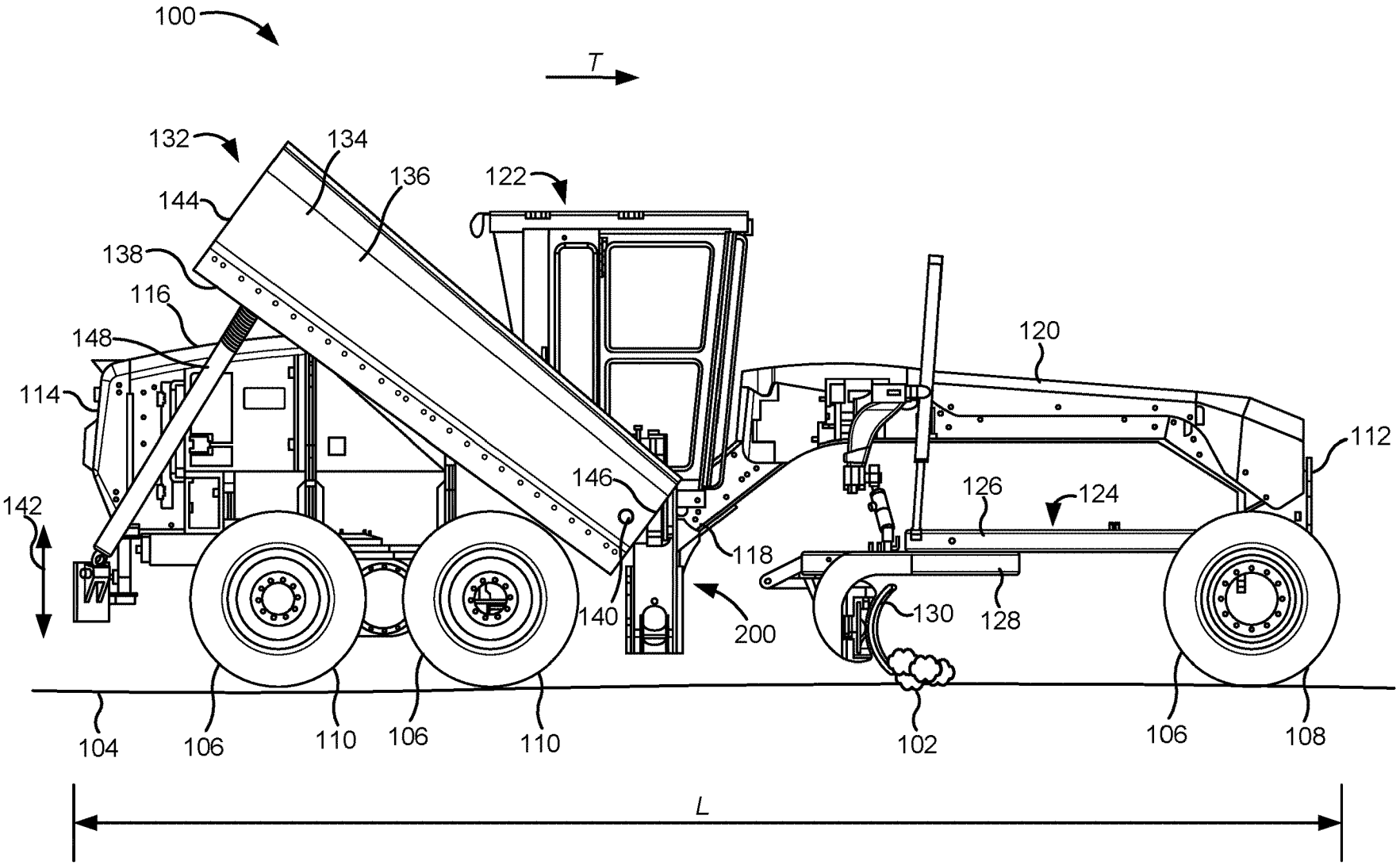
FIG. 1 is a side view of a motor grader described herein.

FIG. 1 is a side view of a motor grader 100 described herein. The motor grader 100 may also be referred to as a grader machine, among other examples. The motor grader 100 may be used to displace, spread, distribute, level, and grade, materials 102, such as snow or soil, over a work surface 104. Generally, a grading operation is performed during machine movement, and for this purpose, the motor grader 100 may include traction devices 106 that facilitate machine movement over the work surface 104. For example, traction devices 106 include a set of front wheels 108 disposed towards a front end 112 of the motor grader 100 and a set of rear wheels 110 disposed towards a rear end 114 of the motor grader 100. The terms "front" and "rear", as used herein, are in relation to an exemplary direction of travel of the motor grader 100, as represented by arrow, T, in FIG. 1, with the direction of travel being exemplarily defined from the rear end 114 towards the front end 112. The motor grader 100 defines a length, L, between the front end 112 and the rear end 114.

A movement of the traction devices 106 (e.g., a rotation of the set of front wheels 108 and the set of rear wheels 110) may be powered by a power source, such as an engine (not shown in FIG. 1), housed in a power compartment 116 of the motor grader 100. Further, the motor grader 100 may include a main frame portion 118 and a sub-frame portion 120. The main frame portion 118 may also be referred to herein as an undercarriage assembly of the motor grader 100. The sub-frame portion 120 may be movable relative to the main frame portion 118. Further, the motor grader 100 may include an operator cab 122 supported on the sub-frame portion 120. The operator cab 122 may house various controls of the power source and other functions of the motor grader 100.

To grade and level the materials 102, the motor grader 100 may include a drawbar-circle-blade (DCB) arrangement or a drawbar-circle-moldboard (DCM) arrangement, which may also be referred to as a grader group 124. The grader group 124 may be supported by the sub-frame portion 120, and may include a drawbar 126, a circle member 128, and a blade 130 (referred to as a moldboard), each of which may function in concert to perform a grading operation on the work surface 104.

As shown in FIG. 1, the motor grader 100 may also include a snow wing assembly 132 mounted on the motor grader 100. For example, the snow wing assembly 132 may be mounted to the main frame portion 118. The snow wing assembly 132 may be mounted on a side of the motor grader 100 (e.g., on a side of the operator cab 122). For example, as shown in FIG. 1, the snow wing assembly 132 may be mounted on the right hand side of the operator cab 122 relative to the direction of travel T. In other examples, the snow wing assembly 132 may be mounted on the left hand side of the operator cab 122 relative to the direction of travel T. The snow wing assembly 132 may include a moldboard 134. The moldboard 134 may also be referred to as a blade, a plow, and/or a snowplow, among other examples. The moldboard 134 may include a surface 136, such as a curved surface or a concave surface, that may help receive and agglomerate the materials 102 over the work surface 104. As an example, the moldboard 134 may define an edge 138 at a bottom end (e.g., closer to the work surface 104) of the surface 136 to help engage and scrape the materials 102 off the work surface 104 and distribute, level, and grade the work surface 104, during a grading operation.

The snow wing assembly 132 may be mounted to the motor grader 100 via a lift assembly 200 (e.g., also referred to herein as a lifting assembly). The lift assembly 200 may be coupled to the motor grader 100 (e.g., via the main frame portion 118). The lift assembly 200 may be configured to link the snow wing assembly 132 to an undercarriage assembly (e.g., the main frame portion 118) of the motor grader 100. The lift assembly 200 may include one or more lifting mechanisms, such as one or more actuators (e.g., hydraulic actuators and/or pneumatic actuators) and/or other components configured to raise and/or lower the snow wing assembly along a direction 142. A vertical clearance of the snow wing assembly 132 in the direction 142 may be referred to as a bench height.

The snow wing assembly 132 may enable the motor grader 100 to perform a benching application, which may involve grading and/or distributing materials 102 from an elevated surface (e.g., elevated relative to the work surface 104). For example, the moldboard 134 may be used to remove, grade, or distribute snow from a top portion of a bank. The moldboard 134 may include an outboard end 144 and an inboard end 146. "Outboard" and "inboard" may be relative to the motor grader 100 and/or the operator cab 122. For example, the moldboard 134 may have an approximately rectangular configuration having two long edges (e.g., the edge 138 and the corresponding edge approximately parallel to the edge 138) and two short edges (e.g., at the outboard end 144 and the inboard end 146). As shown in FIG. 1, the snow wing assembly 132 may be coupled to the lift assembly 200 proximate to the inboard end 146 of the moldboard 134. In other words, the moldboard 134 may be coupled to the lift assembly 200 proximate to one of the short edges (e.g., at the outboard end 144 and the inboard end 146) of the moldboard 134.

The snow wing assembly 132 may be coupled to the lift assembly 200 via a coupling assembly 140. The coupling assembly 140 may enable the snow wing assembly 132 to rotate in multiple rotational directions. For example, the coupling assembly 140 may enable the snow wing assembly 132 (e.g., and the moldboard 134) to rotate in a first rotational direction (e.g., about a rotational axis defined by a pin of the coupling assembly 140). For example, the snow wing assembly 132 may include an actuator 148, such as a hydraulic actuator or a pneumatic actuator, among other examples. The actuator 148 may be coupled to the main frame portion 118 (e.g., proximate to the rear end 114 of the motor grader 100) and to the moldboard 134 (e.g., proximate to the outboard end 144 of the moldboard 134). The coupling assembly 140 may also enable the snow wing assembly 132 (e.g., and the moldboard 134) to rotate in a second rotational direction. The second rotational direction may enable the outboard end 144 of the moldboard 134 to move closer to and/or further from the motor grader 100 (e.g., from the operator cab 122 of the motor grader 100). For example, the inboard end 146 of the moldboard 134 may be fixed at the coupling assembly 140 and the outboard end 144 of the moldboard 134 may be free to rotate in the first rotational direction and the second rotational direction.

As used herein, "actuator" or "cylinder" may refer to a hydraulic cylinder, a hydraulic actuator, a pneumatic cylinder, a pneumatic actuator, rod-style cylinders, and/or welded body cylinders, among other examples. For example, the lift assembly 140 may utilize a fluid system, such as a hydraulic system, to power one or more components of the lift assembly 140. The fluid system may include one or more actuators or cylinders. For example, the lift assembly 140 may include one or more hydraulic cylinders. The hydraulic cylinder(s) may be single acting cylinders, double acting cylinders, tie-rod cylinders, welded rod cylinders, and/or telescopic cylinders, among other examples. The hydraulic cylinder(s) may be internal valve cylinders (e.g., where a control valve is included internally in the cylinder) or external valve cylinder (e.g., where the control value is external to the cylinder). In examples where the lift assembly 140 includes multiple cylinders or actuators, the multiple cylinders or actuators may be included in a single circuit or fluid line, may be included in in separate circuits or fluid lines, may be plumbed in series with one another, and/or may be plumbed in parallel with one another.

The coupling assembly 140 may enable the moldboard 134 to rotate in the second rotation direction via a hinge 150 that is rotatably coupled to the lift assembly 200. The second rotational direction may enable the snow wing assembly 132 to be placed into an operational state (e.g., with the outboard end 144 of the moldboard 134 extended away from the operator cab 122) or a stored state (e.g., with the outboard end 144 of the moldboard 134 rotated proximate to the operator cab 122), as depicted in more detail in FIG. 2. For example, the stored state may enable the motor grader 100 to operate without the snow wing assembly 132 protruding from the side of the motor grader 100.

As indicated above, FIG. 1 is provided as an example. Other examples may differ from what is described with regard to FIG. 1.

Figure 2:
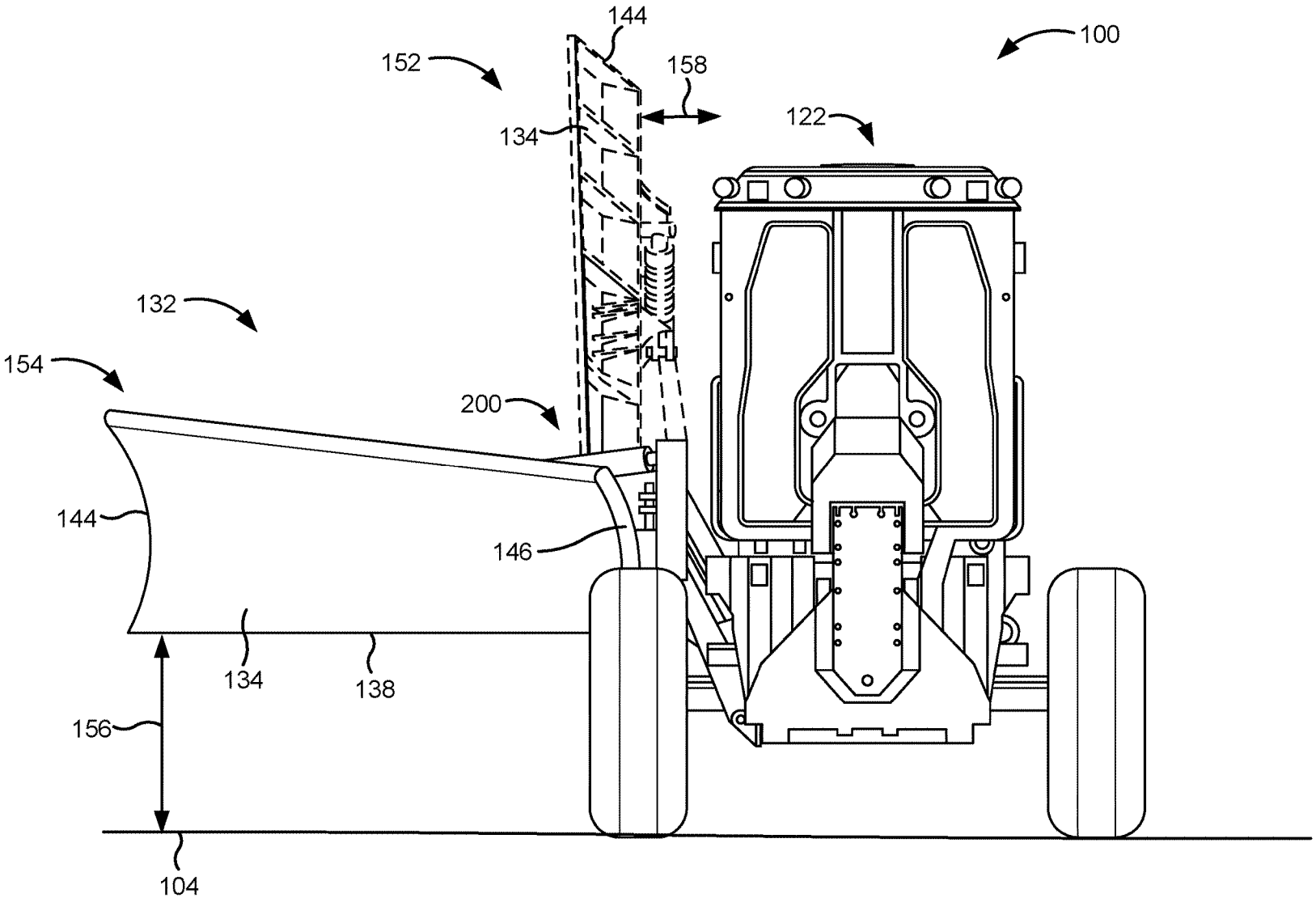
FIG. 2 is a front view of the motor grader described herein.

FIG. 2 is a front view of the motor grader 100 described herein. FIG. 2 depicts the snow wing assembly 132 in various operational positions (e.g., the motor grader 100 depicted in FIG. 2 may include only a single snow wing assembly 132, but FIG. 2 depicts the snow wing assembly 132 in different positions). For example, in a stored state 152, the snow wing assembly 132 may be rotated, in the second rotational direction, with the outboard end 144 of the moldboard 134 rotated proximate to the operator cab 122. In an operational state 154, the snow wing assembly 132 may be rotated, in the second rotational direction, with the outboard end 144 of the moldboard 134 rotated away from the operator cab 122.

As shown in FIG. 2, the snow wing assembly 132 may be associated with a bench height 156. The bench height 156 may be an achievable distance that the lift assembly 200 is capable of raising the snow wing assembly 132 (e.g., the moldboard 134) from a work surface (e.g., the work surface 104) associated with the motor grader 100. For example, the bench height 156 may be measured from the ground to the edge 138 of the moldboard 134. The bench height 156 may be a maximum height that the lift assembly 200 is capable of lifting the snow wing assembly 132 (e.g., the moldboard 134) from the ground. In some examples, the bench height 156 may be greater than 40 inches. More specifically, the bench height 156 may be greater than 50 inches. In some examples, the bench height 156 may be approximately 60 inches.

When the snow wing assembly 132 is raised to the bench height 156, the snow wing assembly 132 (e.g., the moldboard 134) may be a distance 158 from the operator cab 122. For example, as the lift assembly 200 raises the snow wing assembly 132, the lift assembly 200 may cause the snow wing assembly 132 to be pulled closer to the operator cab 122. In other words, when the lift assembly 200 lowers the snow wing assembly 132 to the ground (e.g., to the work surface 104), the lift assembly 200 may cause the snow wing assembly 132 (e.g., the inboard end 146 of the moldboard 134) to be pushed further away from the operator cab 122 than when the snow wing assembly 132 is raised to the bench height 156. The distance 158 may be measured between the inboard end 146 of the moldboard 134 and a side (e.g., a door) of the operator cab 122 on which the snow wing assembly 132 is mounted. The lift assembly 200 may be configured to ensure that the distance 158 is less than or equal to a threshold, such as 6 feet or similar distances. This may ensure that when the snow wing assembly 132 does not extend away from the operator cab 122 when the snow wing assembly 132 is in the stored state 152 (e.g., thereby ensuring that the snow wing assembly 132 does not cause any collisions with nearby objects when the motor grader 100 is in motion and the snow wing assembly 132 is in the stored state 152).

As indicated above, FIG. 2 is provided as an example. Other examples may differ from what is described with regard to FIG. 2.

Figure 3:
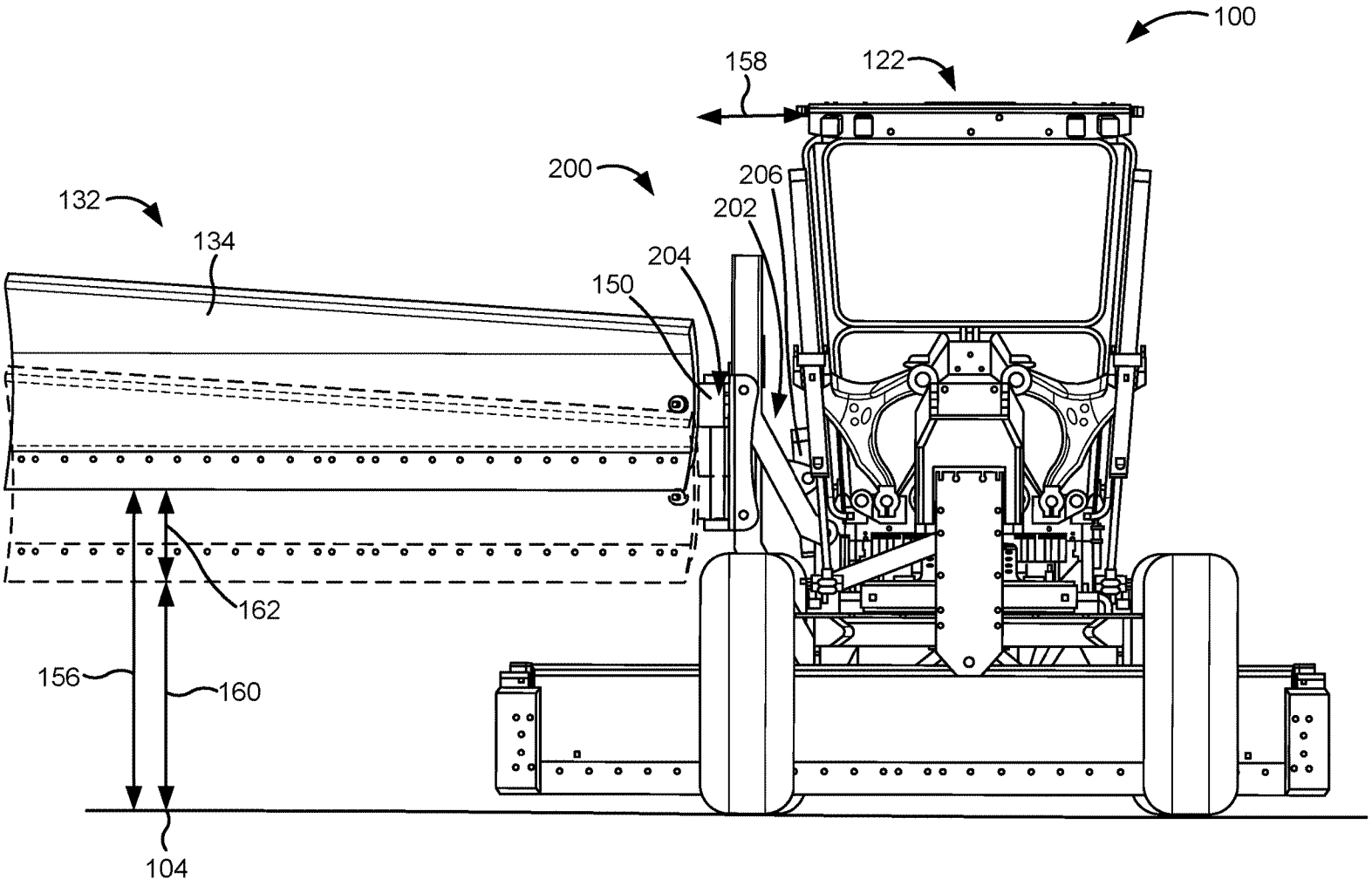
FIG. 3 is a front view of the motor grader and a lift assembly described herein.

FIG. 3 is a front view of the motor grader 100 and the lift assembly 200 described herein. The lift assembly 200 may include a first lifting mechanism 202 and a second lifting mechanism 204. The first lifting mechanism 202 may be mechanically coupled to an undercarriage assembly (e.g., the main frame portion 118) of the motor grader 100. The second lifting mechanism may be mechanically coupled to the first lifting mechanism 202 and the moldboard 134.

The first lifting mechanism 202 may be configured to lift (e.g., raise and/or lower) the moldboard 134 of the snow wing assembly 132 a first portion 160 of the bench height 156 associated with the moldboard 134. The second lifting mechanism 204 may be configured to lift (e.g., raise and/or lower) the moldboard 134 of the snow wing assembly 132 a second portion 162 of the bench height 156 associated with the moldboard 134. In some examples, the first portion 160 may be approximately 75% of the bench height 156 and the second portion 162 may be approximately 25% of the bench height 156. In other examples, the first portion 160 and the second portion 162 may be different percentages of the bench height 156. In other words, the first lifting mechanism 202 may be configured to lift (e.g., raise and/or lower) the moldboard 134 of the snow wing assembly 132 to the first portion 160 of the bench height 156 and the second lifting mechanism 204 may be configured to lift (e.g., raise and/or lower) the moldboard 134 of the snow wing assembly 132 the remainder (e.g., the second portion 162) of the bench height 156. In this way, the lift assembly 200 may be a dual stage lift assembly (e.g., with a first stage being associated with the first lifting mechanism 202 and a second stage being associated with the second lifting mechanism 204).

The first lifting mechanism 202 may include a four-bar linkage configured to lift the moldboard 134 via a hydraulic cylinder 206 associated with the four-bar linkage. The four-bar linkage may include a first vertical member 208, a second vertical member 210, a first horizontal member 212, and a second horizontal member 214. "Vertical" and "horizontal" are provided for ease of description and are not intended to describe an orientation of the members of the four-bar linkage (e.g., the orientation of the members of the four-bar linkage may change as the four-bar linkage moves). The first vertical member 208 may be coupled to the undercarriage assembler of the motor grader 100. The hydraulic cylinder 206 may be coupled to the first vertical member 208 and the first horizontal member 212 such that when the hydraulic cylinder 206 extends a rod of the hydraulic cylinder 206, the four-bar linkage causes the second vertical member 210 to be raised (e.g., because the first vertical member 208 is fixed in position).

The second lifting mechanism 204 may be disposed at, or near, the second vertical member 210 of the four-bar linkage (e.g., of the first lifting mechanism 202). For example, as shown in FIG. 3, the second lifting mechanism 204 may include the hinge 150 slidably coupled to a bar 216. The hinge 150 may be coupled to the moldboard 134. The second lifting mechanism 204 may be configured to cause the hinge 150 to slide along the bar 216. The second lifting mechanism 204 may include an actuator, a hydraulic cylinder, one or more chains, one or more gear systems, a motor, and/or a cable and pulley system, among other examples.

The lift assembly 200 may be configured to raise and/or lower the snow wing assembly 132 and/or the moldboard 134 as described in more detail herein. For example, the first lifting mechanism 202 and the second lifting mechanism 204 may enable the lift assembly 200 to raise the moldboard 134 to a bench height (e.g., the bench height 156) that is greater than or equal to a first threshold distance (e.g., 40 inches, 48 inches, 50 inches, 60 inches, or another distance) and to ensure that a distance (e.g., the distance 158) between the moldboard 134 (e.g., the inboard end 146) and the operator cab 122 of the motor grader is less than a second threshold distance (e.g., 72 inches or similar distances). In other words, the dual stage system of the lift assembly 200 may enable the lift assembly 200 to raise the moldboard 134 to a bench height (e.g., the bench height 156) that is greater than or equal to a first threshold distance while also ensuring that the distance (e.g., the distance 158) between the moldboard 134 (e.g., the inboard end 146) and the operator cab 122 is not too large so as to cause collisions with nearby objected when the moldboard 134 is raised to the bench height 156 and/or when the snow wing assembly 132 is in the stored state 152.

As indicated above, FIG. 3 is provided as an example. Other examples may differ from what is described with regard to FIG. 3.

Figure 4:
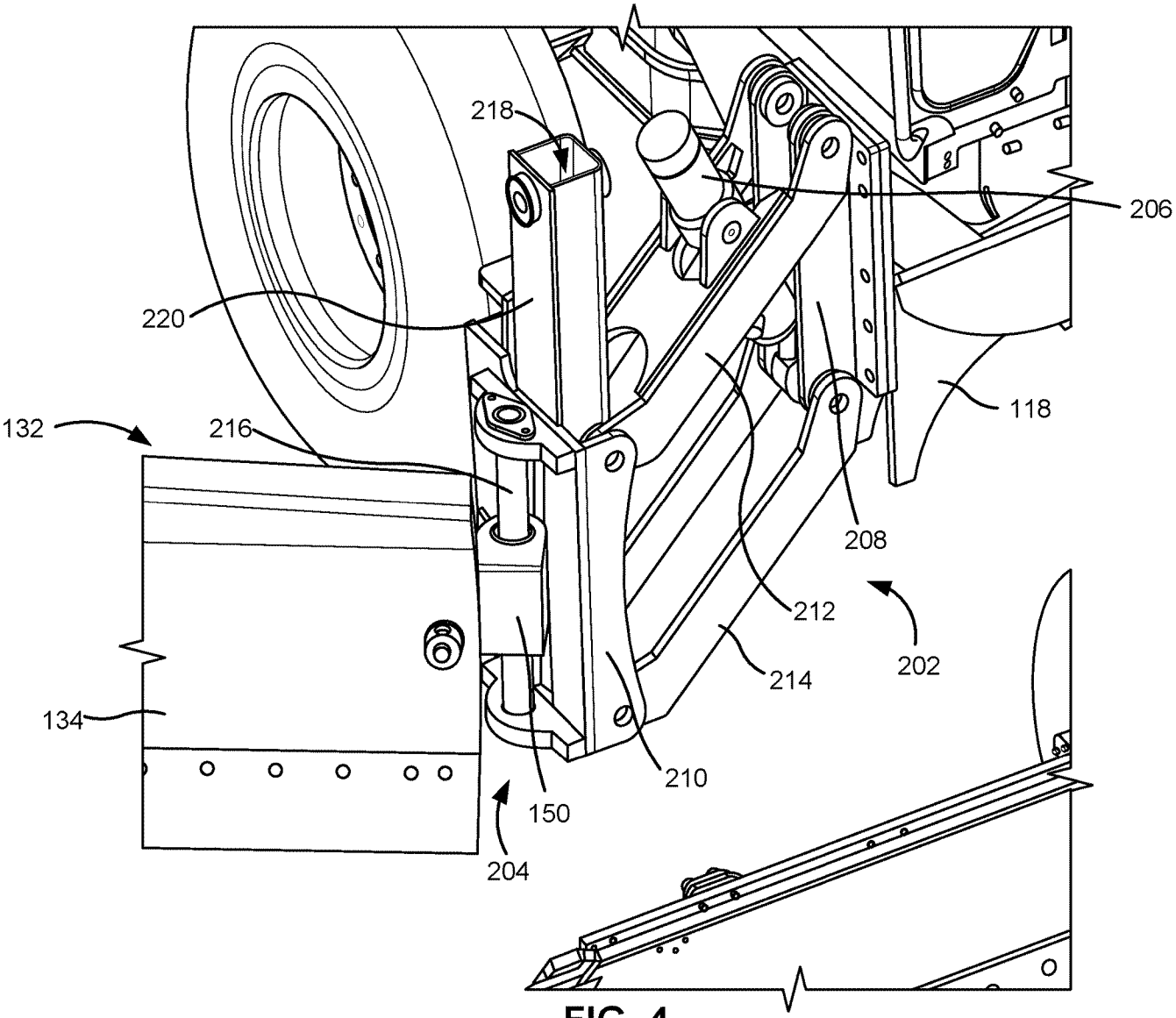
FIG. 4 is a perspective view of the lift assembly described herein.

FIG. 4 is a perspective view of the lift assembly 200 described herein. The example lift assembly 200 depicted in FIG. 4 include the first lifting mechanism 202 having a first hydraulic cylinder (e.g., the hydraulic cylinder 206) and the second lifting mechanism 204 having a hydraulic cylinder 218 (not shown in FIG. 4).

As shown in FIG. 4, the hydraulic cylinder 206 may be mounted to the first vertical member 208 and the first horizontal member 212. For example, a head end of the hydraulic cylinder 206 may be coupled to the first horizontal member 212 and a rod end of the hydraulic cylinder 206 may be coupled to the first vertical member 208. The rod end of the hydraulic cylinder 206 may be coupled to a joint between the first vertical member 208 and the second horizontal member 214. The hydraulic cylinder 206 may be configured to extend the rod of the hydraulic cylinder 206 to cause the second vertical member 210 to be raised (e.g., relative to the first vertical member 208 that is fixed to the undercarriage assembly of the motor grader 100) to cause the moldboard 134 to be raised the first portion 160 of the bench height 156. Similarly, the hydraulic cylinder 206 may be configured to retract the rod of the hydraulic cylinder 206 to cause the second vertical member 210 to be lowered (e.g., relative to the first vertical member 208 that is fixed to the undercarriage assembly of the motor grader 100) to cause the moldboard 134 to be lowered the first portion 160 of the bench height 156.

The second lifting mechanism 204 may include the hydraulic cylinder 218 (e.g., mounted approximately parallel relative to the bar 216) configured to slide the hinge 150 along the bar 216 to lift the moldboard 134 the second portion 162 of the bench height 156. The hydraulic cylinder 218 may be mounted inside a mast 220 of the second lifting mechanism 204. For example, a head end of the hydraulic cylinder 218 may be coupled to a top end of the mast 220 (e.g., via a pin or other means). A rod of the hydraulic cylinder 218 may be coupled to the hinge 150 (e.g., to be configured to cause the hinge 150 to slide along the bar 216). The mast 220 may be positioned above the bar 216 and coupled to the second vertical member 210 of the first lifting mechanism 202.

In other examples, the second lifting mechanism 204 may not include the mast 220. In such examples, the hydraulic cylinder 218 may be mounted at least partially within the second vertical member 210 of the first lifting mechanism 202 (e.g., of the four-bar linkage). For example, the hydraulic cylinder 218 may be mounted at least partially within the second vertical member 210 positioned behind the bar 216.

The hinge 150 may be slidably and rotatably coupled to the bar 216. For example, the hinge 150 may include a sleeve 164 that is disposed around the bar 216. The hinge 150 may be configured to slide up and down along the bar 216 (e.g., to raise and/or lower the moldboard 134 the second portion 162 of the bench height 156) and the rotate around the bar 216 (e.g., to rotate the moldboard 134 in the second rotational direction described above). A rod of the hydraulic cylinder 218 may be coupled to the hinge 150. For example, in some cases, the hydraulic cylinder 218 may be configured to retract the rod to cause the hinge 150 to slide up the bar 216 (e.g., to cause the moldboard 134 to raise the second portion 162 of the bench height 156). Similarly, the hydraulic cylinder 218 may be configured to extend the rod to cause the hinge 150 to slide down the bar 216 (e.g., to cause the moldboard 134 to lower the second portion 162 of the bench height 156).

A sequencing of the hydraulic cylinder 206 and the hydraulic cylinder 218 may be based on a design of a hydraulic circuit associated with the hydraulic cylinder 206 and the hydraulic cylinder 218 and/or relative sizes of the hydraulic cylinder 206 and the hydraulic cylinder 218. For example, a sequencing of the hydraulic cylinder 206 and the hydraulic cylinder 218 (e.g., to cause one of the cylinders to actuate first relative to the other cylinder) may be based on a plumbing design (e.g., whether the cylinders are plumbed in series or parallel) and/or one or more valves, such as a pressure relief valve, a diverter valve, and/or a bypass valve, among other examples, included in the hydraulic circuit. Additionally, or alternatively, the sequencing of the hydraulic cylinder 206 and the hydraulic cylinder 218 may be based on the relative sizes (e.g., volumes) of the hydraulic cylinder 206 and the hydraulic cylinder 218. For example, the hydraulic cylinder 206 may be larger (e.g., in volume) than the hydraulic cylinder 218 (e.g., because the hydraulic cylinder 206 may need to lift a combined weight of the first lifting mechanism 202, the second lifting mechanism 204, and the snow wing assembly 132, whereas the hydraulic cylinder 218 may only need to lift a combined weight of the first lifting mechanism 202 and the snow wing assembly 132). Therefore, the hydraulic cylinder 206 may actuate prior to the hydraulic cylinder 218 due to the size of the hydraulic cylinder 206 being larger than the hydraulic cylinder 218.

As indicated above, FIG. 4 is provided as an example. Other examples may differ from what is described with regard to FIG. 4.

Figure 5:
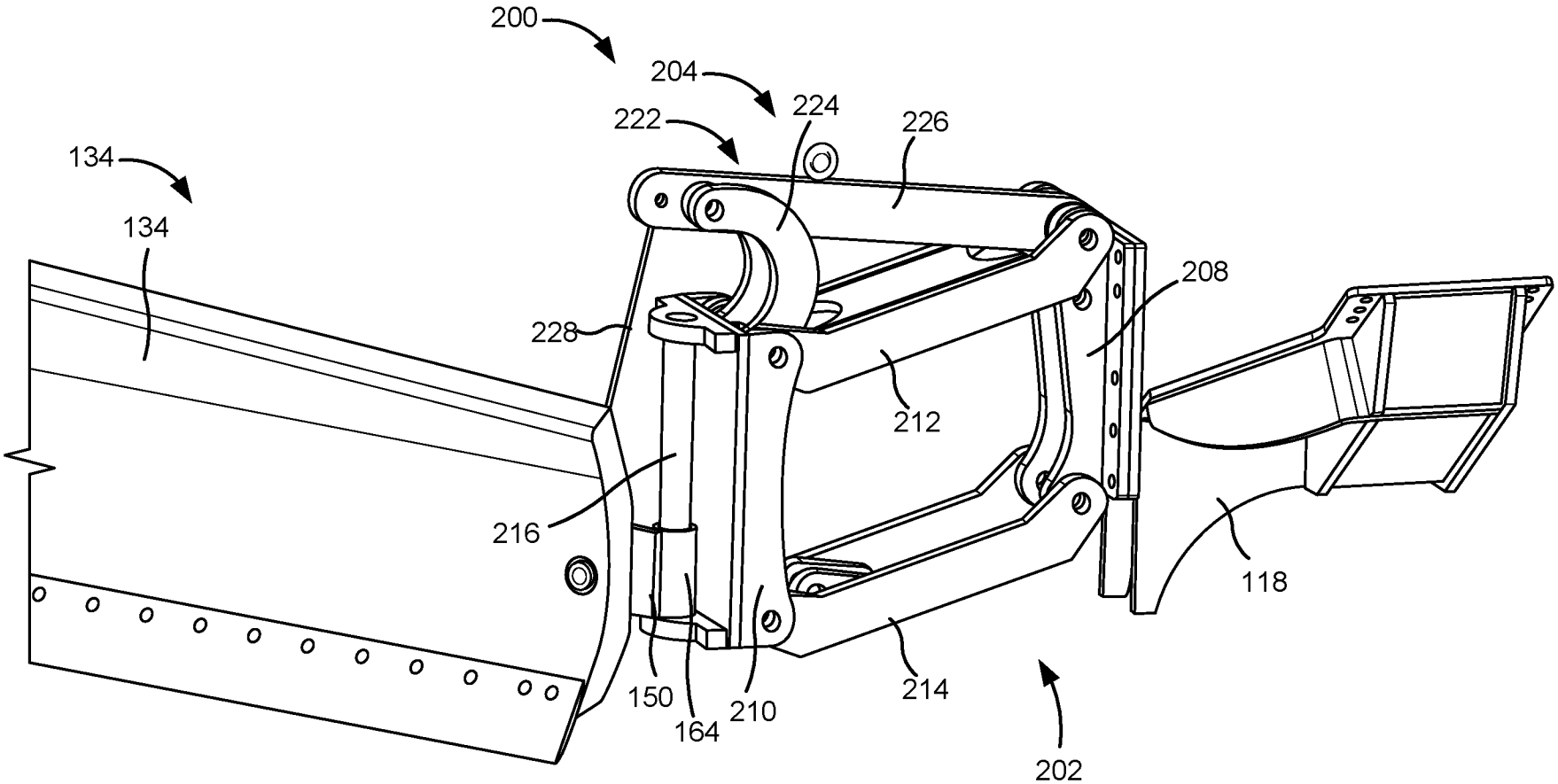
FIGS. 5-7 are perspective views of the lift assembly including a knuckle linkage described herein.
Figure 6:
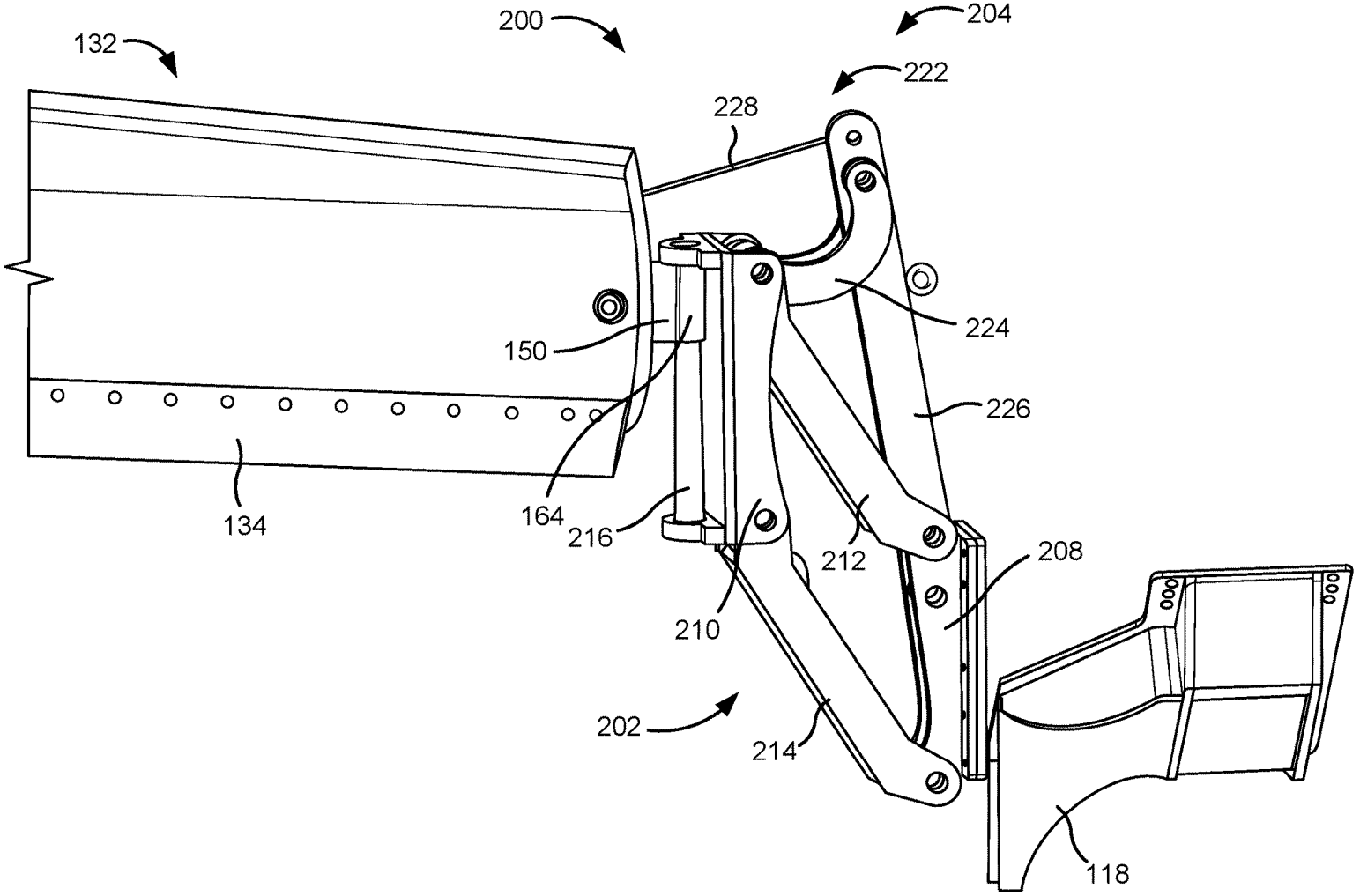
Figure 7:
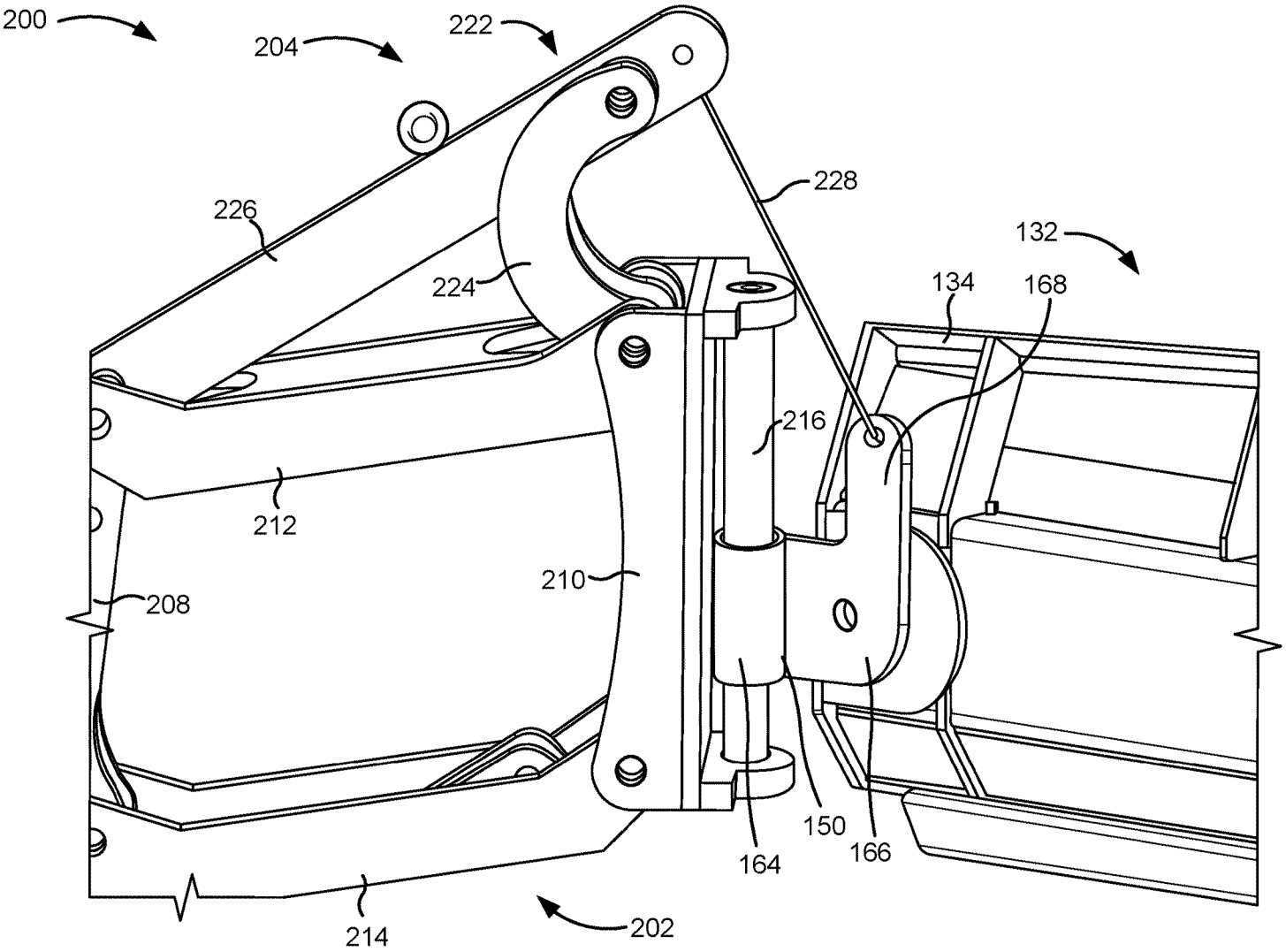

FIGS. 5-7 are perspective views of the lift assembly 200 including a knuckle linkage 222 described herein. As shown in FIG. 5, the second lifting mechanism 204 may include the knuckle linkage 222. For example, rather than including an actuator or a cylinder (e.g., the hydraulic cylinder 218), the second lifting mechanism 204 may include one or more mechanical components (e.g., the knuckle linkage 222) that are configured to cause the moldboard 134 to be raised and/or lowered the second portion 162 of the bench height 156.

In a similar manner as described elsewhere herein, the second lifting mechanism 204 may include the hinge 150 slidably (e.g., and rotatably) coupled to the bar 216. The knuckle linkage 222 may include a first member 224 and a second member 226. The first member 224 may be a knuckle member or a knuckle component. For example, the first member 224 may be a curved member (e.g., may have a curved configuration). The first member 224 may be coupled to the second vertical member 210 of the first lifting mechanism 202. For example, the first member 224 may be coupled to the second vertical member 210 at a joint between the second vertical member 210 and the first horizontal member 212. For example, the joint may be associated with a rotatable coupling of the first member 224, the second vertical member 210 and the first horizontal member 212. Additionally, the first member 224 may be coupled to the second member 226 (e.g., at an opposite end from which the first member 224 is coupled to the second vertical member 210). For example, a coupling of the first member 224 and the second member 226 may be a distance from the joint between the second vertical member 210 and the first horizontal member 212.

The second member 226 may be coupled to the first vertical member 208 of the first lifting mechanism 202. For example, the second member 226 may be coupled to the first vertical member 208 at a joint between the first vertical member 208 and the first horizontal member 212. For example, the joint may be associated with a rotatable coupling of the second member 226, the first vertical member 208 and the first horizontal member 212.

The second lifting mechanism 204 may include a third member 228. The third member 228 may be coupled to the second member 226 and the hinge 150. For example, the third member 228 may be coupled to the second member 226 at an end of the second member 226 (e.g., that is proximate to the coupling of the second member 226 with the first member 224). The third member 228 may be a hard link or mechanical link (e.g., may be a length of metal or other rigid material) or may be a flexible link, such as a chain or a cable (e.g., that is part of a cable and pulley system). For example, a pulley may be included at a coupling of the third member 228 to the second member 226. A flexible link may enable a mechanical float of the hinge 150 and/or the moldboard 134. The mechanical float is described in more detail elsewhere herein.

The knuckle linkage 222 may be configured to cause the third member 228 to lift the hinge 150 along the bar 216 as the first lifting mechanism raises the moldboard 134. For example, as shown in FIG. 5, the first lifting mechanism 202 may be the four-bar linkage. The four-bar linkage may be configured to be raised or lowered (e.g., the second vertical member 210 may be raised or lowered relative to the first vertical member 208) via an actuator or hydraulic cylinder (e.g., in a similar manner as described above) or via another means. FIG. 5 depicts a configuration in which the four-bar linkage (e.g., the first lifting mechanism 202) is in a lowered state. As shown, the hinge 150 may be slide down the bar 216 (e.g., to cause the moldboard 134 to lower the second portion 162 of the bench height 156) because the hinge 150 is slidably coupled to the bar 216 and because the third member 228 is positioned to provide enough slack to the hinge 150 to allow the hinge 150 to slide down the bar 216.

As shown in FIG. 6, as the four-bar linkage of the first lifting mechanism 202 raises the second vertical member 210 relative to the first vertical member 208 (e.g., to raise the moldboard 134 the first portion 160 of the bench height 156), the knuckle linkage 222 of the second lifting mechanism 204 may cause the third member 228 to slide the hinge 150 up the bar 216 (e.g., to cause the moldboard 134 to be raised the second portion 162 of the bench height 156). For example, because the first member 224 and the second member 226 may be rigid members, as the second vertical member 210 is raised relative to the first vertical member 208, the coupling of the first member 224 and the second member 226 may be forced away from the second vertical member 210 and towards the first vertical member 208 (e.g., as shown in FIG. 6). Therefore, as the end of the second member 226 moves away from the second vertical member 210, the third member 228 may pull the hinge 150 to cause the hinge 150 to slide up the bar 216 (e.g., to cause the moldboard 134 to be raised the second portion 162 of the bench height 156).

FIG. 7 depicts a back view of the knuckle linkage 222 described herein. As shown in FIG. 7, the third member 228 may be coupled to the hinge 150. The hinge 150 may be coupled to the moldboard 134 (e.g., via a pin, not shown in FIG. 7). In some implementations, the hinge 150 may include a plate 166. The plate 166 may be configured to mate with the moldboard 134 (e.g., with a plate of the moldboard 134). The third member 228 may be coupled with the plate 166 of the hinge 150 (e.g., via an aperture or hole in the plate 166 as shown in FIG. 7).

In some implementations, the plate 166 may include a portion 168 that extends away from the plate 166. For example, the plate 166 may have an "L" shape, defined by the plate 166 and the portion 168. The portion 168 may extend in a direction that is substantially parallel with the bar 216. The third member 228 may be coupled with the plate 166 at the portion 168 (e.g., proximate to an end of the portion 168). For example, as shown in FIG. 7, the first portion 160 may include an aperture proximate to an end of the portion 168 and the third member 228 may be coupled to the portion 168 via the aperture.

As the first lifting mechanism 202 raises the moldboard 134 the first portion 160 of the bench height 156 (e.g., as the second vertical member 210 rises relative to the first vertical member 208), an end of the second member 226 (e.g., to which the third member 228 is coupled) may move away from a top of the second vertical member 210. As a result, the third member 228 may pull the hinge 150 to cause the hinge 150 to slide up the bar 216 (e.g., thereby causing the moldboard 134 to rise the second portion 162 of the bench height 156). Similarly, as the first lifting mechanism 202 lowers the moldboard 134 the first portion 160 of the bench height 156 (e.g., as the second vertical member 210 lowers relative to the first vertical member 208), an end of the second member 226 (e.g., to which the third member 228 is coupled) may move toward the top of the second vertical member 210. As a result, the third member 228 may allow the hinge 150 to slide down the bar 216 (e.g., thereby causing the moldboard 134 to lower the second portion 162 of the bench height 156). In this way, the dual stage lifting system may be achieved by the lift assembly 200.

As indicated above, FIGS. 5-7 are provided as examples. Other examples may differ from what is described with regard to FIGS. 5-7.

Figure 8:
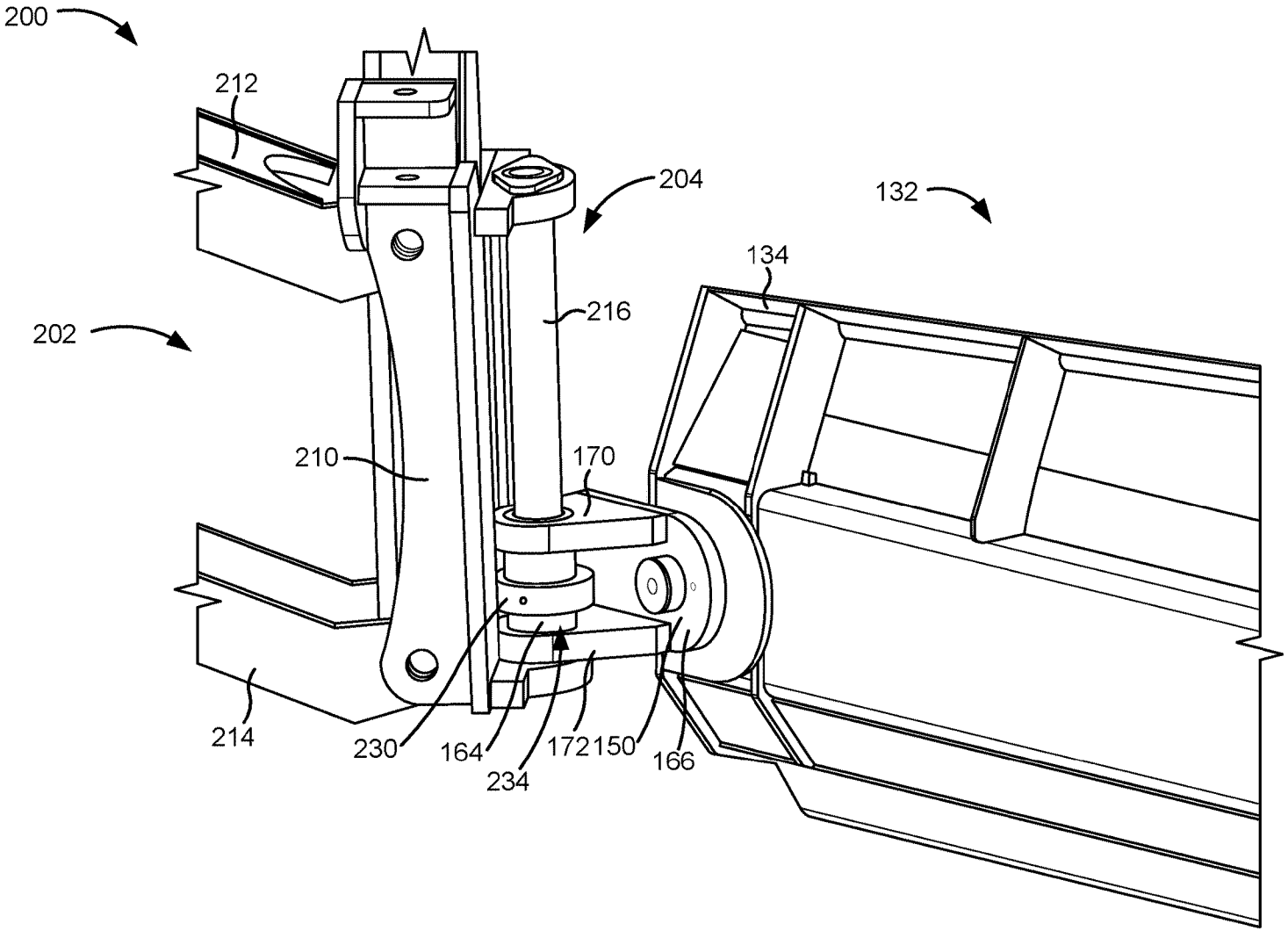
FIG. 8 is a perspective view of the lift assembly described herein.

FIG. 8 is a perspective view of the lift assembly 200 described herein. The second lifting mechanism 204 may include a collar 230. As shown in FIG. 7, the collar 230 may be disposed about (e.g., around) the hinge 150 (e.g., around the sleeve 164 of the hinge 150). For example, the collar 230 may be slidably mounted to the hinge 150 (e.g., around the sleeve 164).

The collar 230 may extend fully around the hinge 150 (e.g., around the sleeve 164). Alternatively, the collar 230 may extend partially around the hinge 150 (e.g., around the sleeve 164). The collar 230 may be configured to raise and/or lower the hinge 150 by contacting the hinge 150. For example, the hinge 150 may include an upper plate 170 and a lower plate 172. The upper plate 170 and the lower plate 172 may be disposed at opposite ends of the sleeve 164. The collar 230 may include one or more features to facilitate movement along the hinge 150 and/or sleeve 164. For example, the one or more features may include one or more wear strips, and/or one or more bearings, among other examples.

To raise the hinge 150 along the bar 216, the collar 230 may be configured to contact the upper plate 170. In other words, the collar 230 may be configured to lift the hinge 150 along the bar 216 via contacting the upper plate 170. For example, the collar 230 may be coupled to a rod 232 (shown in FIG. 7) of the hydraulic cylinder 218. As the hydraulic cylinder 218 actuates to move the rod 232, the collar 230 may in turn move to cause the hinge 150 to slide along the bar 216 (e.g., by contacting the upper plate 170 of the hinge 150).

FIG. 8 depicts the lift assembly 200 in a lowered position (e.g., when the moldboard 134 is at, or near, the ground or the work surface 104). As shown, there may be a gap 234 between the collar 230 and the lower plate 172 when the moldboard 134 is in the lowered position. In other words, the hinge 150 may be free to slide along bar 216 for some distance (e.g., defined by the gap 234) when the moldboard 134 is in the lowered position. This may enable a mechanical float feature for the moldboard 134, as explained in more detail elsewhere herein.

As indicated above, FIG. 8 is provided as an example. Other examples may differ from what is described with regard to FIG. 8.

Figure 9:
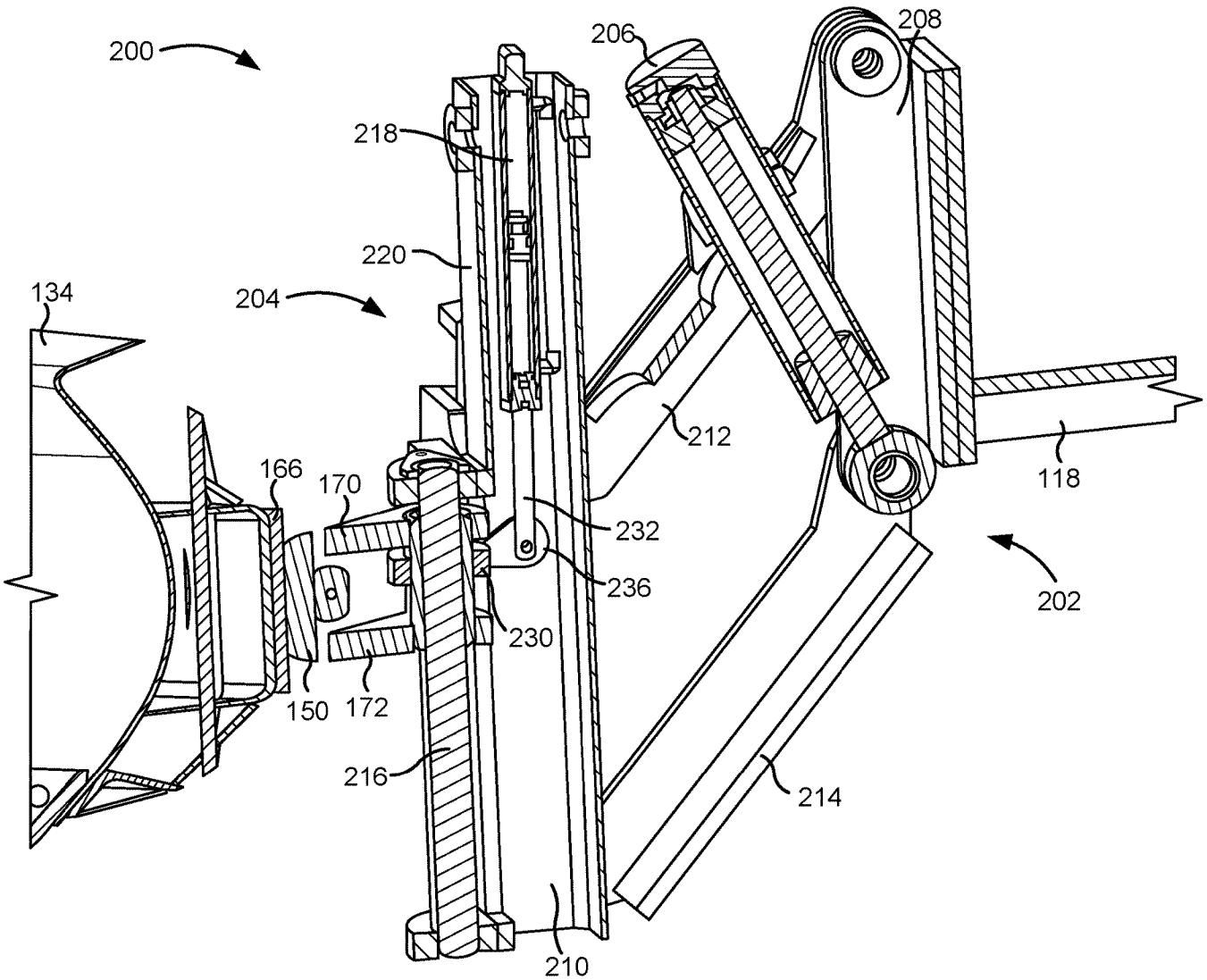
FIG. 9 is a cut away view of the lift assembly described herein.

FIG. 9 is a cut away view of the lift assembly 200 described herein. As shown in FIG. 9, the hydraulic cylinder 218 may be mounted within the mast 220. Alternatively, the hydraulic cylinder 218 may be mounted at least partially within the second vertical member 210 (e.g., and the second lifting mechanism 204 may not include the mast 220). The hydraulic cylinder 218 may include the rod 232 coupled to the hinge 150, thereby enabling the hydraulic cylinder 218 to raise and lower the hinge 150 and the moldboard 134 attached thereto.

The collar 230 may be coupled to the rod 232. For example, the collar 230 may include a component 236 extending into the second vertical member 210 and/or the mast 220. The rod 232 may be coupled to the component 236. Therefore, as the rod 232 is extended and retracted via the hydraulic cylinder 218, the collar 230 may be moved up and down with the rod 232. When the rod 232 is retracted by the hydraulic cylinder 218, the collar 230 may be pulled up toward the hydraulic cylinder 218. As a result, the collar 230 may contact the upper plate 170 of the hinge 150. This may cause the hinge 150 to slide up the bar 216 toward the hydraulic cylinder 218 (e.g., thereby causing the moldboard 134 to be raised the second portion 162 of the bench height 156).

As the rod 232 is extended from the hydraulic cylinder 218, the collar 230 may be pushed away from the hydraulic cylinder 218. Therefore, the collar 230 may no longer contact the upper plate 170 of the hinge 150 and/or may contact the lower plate 172 of the hinge 150. This may cause the hinge 150 to slide down the bar 216 away from the hydraulic cylinder 218 (e.g., thereby causing the moldboard 134 to be lowered the second portion 162 of the bench height 156). When the hinge 150 reaches the bottom of the bar 216, there may be the gap 234 between the collar 230 and the lower plate 172 of the hinge 150. The moldboard 134 may be raised and/or lowered the first portion 160 of the bench height 156 via the first lifting mechanism in a similar manner as described elsewhere herein (e.g., via a four-bar linkage in which the second vertical member 210 is raised and/or lowered relative to the first vertical member 208).

As indicated above, FIG. 9 is provided as an example. Other examples may differ from what is described with regard to FIG. 9.

INDUSTRIAL APPLICABILITY

Machines, such as the motor grader 100, may use a snow wing (e.g., often including a moldboard 134) to displace, move, distribute, and/or grade snow and/or other material. The snow wing may need to be moved to various positions relative to a work surface and/or the grader machine to effectively carry out one or more of the functions described above and/or to enable other operations of the grader machine. For example, the snow wing may be mounted on a side of a cab of the grader machine and may need to be raised, relative to the ground, to performing a benching operation. The motor grader 100 may utilize a mast to enable the snow wing to be raised to a bench height 156. For example, the snow wing may be raised or lowered along the mast via one or more actuators. However, the mast may present an impediment to accessing an operator cab of the motor grader 100. Additionally, the mast may block or impede a view of an operator from inside of the operator cab 122.

As another example, the motor grader 100 may utilize a mast-less system to enable the snow wing to be raised to a bench height 156. However, the mast-less system may be limited as to an achievable bench height 156 for the snow wing. For example, a four-bar linkage alone may be used in mast-less systems to raise and/or lower the moldboard 134 to the bench height. However, to achieve a higher bench height, a length of members (e.g., the first horizontal member 212 and the second horizontal member 214) may be increased. However, increasing the length of the members places additional stress on the lift assembly because it moves the mass to be lifted (e.g., the snow wing assembly 132) further from the point at which the lift assembly is coupled to the motor grader 100. Additionally, increasing the length of the members results in the snow wing assembly being a further distance (e.g., the distance 158) from the operator cab 122, resulting in the moldboard 134 potentially causing collisions with nearby objects when in the stored state 152. Therefore, the mast-less system may be unable to perform certain operations that require a bench height greater than the achievable bench height associated with the mast-less system.

The dual stage lift assembly 200 described herein addresses one or more of the above problems. For example, using a dual stage lift system (e.g., including the first lifting mechanism 202 and the second lifting mechanism 204) enable the lift assembly 200 to increase the achievable bench height 156 of the moldboard 134 without adding additional stresses to the lift assembly 200 and/or without causing the distance (e.g., the distance 158) between the operator cab 122 and the moldboard 134 to be increased significantly. For example, the lift assembly 200 may include a mast 220 that has a reduced size compared to traditional mast systems (e.g., because the mast 220 only needs to house the hydraulic cylinder 218 and does not need to enable the moldboard to raise and/or lower the entire bench height 156). Alternatively, the lift assembly 200 may not include any masts. Reducing the size of the mast and/or eliminating the mast may result in reducing an impedance to an operator of the motor grader 100 (e.g., because the reduced size mast and/or eliminated mast may reduce a blockage of a field of view from within the operator cab 122 and/or enable operator ingress and/or egress from the operator cab 122).

Additionally, the collar 230 of the lift assembly 200 may provide a mechanical float for the moldboard 134. As used herein, "mechanical float" may refer to enabling the moldboard 134 to "float" up and down a limited distance (e.g., when in the lowered position). For example, in the lowered position, the moldboard 134 may be in contact with the work surface 104. As the motor grader 100 travels along the work surface 104, the moldboard 134 may contact an object (e.g., a large rock, a manhole cover, a curb of a road, or another object). The mechanical float feature may enable the moldboard 134 to lift up and over the immovable object, rather than directly contacting the immovable object and placing sudden forces on the moldboard 134 and/or the lift assembly 200. As a result, the mechanical float feature reduces wear on the components of the snow wing assembly 132 and/or the lift assembly 200 and reduces a likelihood of sudden and/or strong forces being applied to the components of the snow wing assembly 132 and/or the lift assembly 200 as a result of the moldboard 134 contacting an object.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A lift assembly for a moldboard of a snow wing assembly of a motor grader, comprising:

a first lifting mechanism mechanically coupled to an undercarriage assembly of the motor grader, wherein the first lifting mechanism is configured to lift the moldboard of the snow wing assembly to a first portion of a bench height associated with the moldboard; and a second lifting mechanism mechanically coupled to the first lifting mechanism and the moldboard, wherein the second lifting mechanism is configured to lift the moldboard of the snow wing assembly a second portion of the bench height associated with the moldboard, wherein the second lifting mechanism comprises at least one of:

a curved member, connected to the first lifting mechanism and a plate of a hinge slidably coupled to a bar, to lift the moldboard, a collar, slidably mounted about the hinge, configured to contact an upper plate or a lower plate, of the hinge, to cause the hinge to slide along the bar to lift the moldboard, or a first hydraulic cylinder, mounted within a vertical member of the first lifting mechanism or a mast of the second lifting mechanism, including a rod coupled to the hinge to lift the moldboard.

2. The lift assembly of claim 1, wherein the first lifting mechanism includes a four-bar linkage configured to lift the moldboard via a second hydraulic cylinder associated with the four-bar linkage.

3. The lift assembly of claim 1, wherein the hinge is slidably mounted on the bar and is coupled to the moldboard, and wherein the first hydraulic cylinder is mounted approximately parallel relative to the bar and configured to slide the hinge along the bar to lift the moldboard the second portion of the bench height.

4. The lift assembly of claim 3, wherein the hydraulic cylinder is mounted within the mast and coupled to the vertical member of the first lifting mechanism.

5. The lift assembly of claim 3, wherein the hinge includes the upper plate and the lower plate, wherein the collar is coupled to the rod and is configured to lift the hinge along the bar via contacting the upper plate, and wherein there is a gap between the collar and the lower plate when the moldboard is in a lowered position.

6. The lift assembly of claim 1, wherein the bench height associated with the moldboard is greater than or equal to a first threshold distance, and wherein a distance between the moldboard and a cab of the motor grader is less than a second threshold distance.

7. The lift assembly of claim 1, wherein the hinge is slidably mounted on the bar and is coupled to the moldboard, wherein the second lifting mechanism includes a knuckle linkage that is coupled to the first lifting mechanism and that includes a member coupled to the hinge, and wherein the knuckle linkage is configured to cause the member to lift the hinge along the bar as the first lifting mechanism raises the moldboard.

8. The lift assembly of claim 7, wherein the member includes at least one of:

a mechanical link, a cable and pulley system, or a chain.

9. A snow wing assembly, comprising:

a moldboard; and a lifting assembly configured to lift the moldboard to a bench height, wherein the lifting assembly includes:

a four-bar linkage coupled to an undercarriage assembly of a vehicle, wherein the four-bar linkage is configured to lift the moldboard to a first portion of the bench height via a first hydraulic cylinder associated with the four-bar linkage; and a lifting mechanism coupled to the four-bar linkage and the moldboard, wherein the lifting mechanism is configured to lift the moldboard to a second portion of the bench height, and wherein the lifting mechanism comprises at least one of:

a curved member, connected to the four-bar linkage and a plate of a hinge slidably coupled to a bar, to lift the moldboard, a collar, slidably mounted about the hinge, configured to contact an upper plate or a lower plate, of the hinge, to cause the hinge to slide along the bar to lift the moldboard, or a second hydraulic cylinder, mounted within a vertical member of the four-bar linkage or a mast of the lifting mechanism, including a rod coupled to the hinge to lift the moldboard.

10. The snow wing assembly of claim 9, wherein the hinge is slidably mounted on the bar and is coupled to the moldboard, and wherein the second hydraulic cylinder is configured to slide the hinge along the bar to lift the moldboard the second portion of the bench height.

11. The snow wing assembly of claim 9, wherein the second hydraulic cylinder is mounted at least partially within the vertical member of the four-bar linkage.

12. The snow wing assembly of claim 9, wherein the hinge includes the upper plate and the lower plate, wherein the collar is configured to lift the hinge along the bar via contacting the upper plate, and wherein there is a gap between the collar and the lower plate when the moldboard is in a lowered position.

13. The snow wing assembly of claim 12, wherein the collar extends partially around the hinge or fully around the hinge.

14. The snow wing assembly of claim 9, wherein the hinge is slidably mounted on the bar, and wherein the lifting mechanism includes a component coupled to the four-bar linkage and a link coupled to the hinge and the component, wherein the component is configured to lift the hinge along the bar via the link based on the four-bar linkage raising the moldboard the first portion of the bench height.

15. The snow wing assembly of claim 14, wherein the curved member is a knuckle component coupled to the member of the four-bar linkage, wherein the knuckle component is coupled to the component of the lifting mechanism, and wherein the component is coupled to another member of the four-bar linkage.

16. A motor grader, comprising:

a snow wing assembly including a moldboard; and a lifting assembly for lifting the moldboard to a bench height, wherein the lifting assembly is coupled to an undercarriage assembly of the motor grader, and wherein the lifting assembly includes:

a first lifting mechanism mechanically coupled to the undercarriage assembly, wherein the first lifting mechanism is configured to lift the moldboard of the snow wing assembly to a first portion of the bench height; and a second lifting mechanism mechanically coupled to the first lifting mechanism and the moldboard, wherein the second lifting mechanism is configured to lift the moldboard of the snow wing assembly to a second portion of the bench height, and wherein the second lifting mechanism comprises at least one of:

a curved member, connected to the first lifting mechanism and a plate of a hinge slidably coupled to a bar, to lift the moldboard, a collar, slidably mounted about the hinge, configured to contact an upper plate or a lower plate, of the hinge, to cause the hinge to slide along the bar to lift the moldboard, or a first hydraulic cylinder, mounted within a first vertical member of the first lifting mechanism or a mast of the second lifting mechanism, including a rod coupled to lift the moldboard.

17. The motor grader of claim 16, wherein the first lifting mechanism includes a four-bar linkage configured to lift the moldboard via a second hydraulic cylinder associated with the four-bar linkage; and wherein the hinge is slidably mounted on the bar and is coupled to the moldboard, and wherein the second hydraulic cylinder is configured to slide the hinge along the bar to lift the moldboard the second portion of the bench height.

18. The motor grader of claim 16, wherein the hinge is slidably mounted on the bar and includes the upper plate and the lower plate, wherein the collar is coupled to the rod and the hinge, wherein the collar is configured to lift the hinge along the bar via contacting the upper plate, and wherein there is a gap between the collar and the lower plate when the moldboard is in a lowered position.

19. The motor grader of claim 16, wherein the snow wing assembly is mounted on a side of an operator cab of the motor grader.

20. The motor grader of claim 16, wherein the first lifting mechanism includes a four-bar linkage that includes the first vertical member, a second vertical member, a first horizontal member, and a second horizontal member, wherein the first vertical member is coupled to the undercarriage assembly, and wherein the second lifting mechanism is at least partially included in the second vertical member.

* * * * *